US006416521B1

(12) United States Patent
Waldner et al.

(10) Patent No.: US 6,416,521 B1
(45) Date of Patent: Jul. 9, 2002

(54) DEPILATION SYSTEM WITH A DEPILATION DEVICE AND A COOLING DEVICE

(75) Inventors: Roland Waldner, Pubersdorf; Christian Schumi, Villach, both of (AT); Natassia Jacobs, Rotterdam (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/590,826

(22) Filed: Jun. 9, 2000

(30) Foreign Application Priority Data

Jun. 11, 1999 (EP) ..... 99890187

(51) Int. Cl.[7] ..... A61B 17/50
(52) U.S. Cl. ..... 606/133
(58) Field of Search ..... 606/131, 133, 606/211, 20, 22, 23; 607/96, 114

(56) References Cited

U.S. PATENT DOCUMENTS 2,714,788 A * 8/1955 Giovanna ..... 606/133
5,041,122 A * 8/1991 Schneider et al. ..... 606/133
5,849,018 A * 12/1998 Rosson et al. ..... 606/133

FOREIGN PATENT DOCUMENTS

| | | |
|---|---|---|
| EP | 0348862 A2 | 1/1990 |
| EP | 0443914 A1 | 8/1991 |
| EP | 0532106 B1 | 3/1993 |
| EP | 0532107 B1 | 3/1993 |

* cited by examiner

*Primary Examiner*—Eduardo C. Robert
(74) *Attorney, Agent, or Firm*—Ernestine C. Bartlett

(57) ABSTRACT

A depilation system (1) with a depilation device (2) and a cooling device (3). The housing (4) of the depilation device (2) is of angled design and is provided with a front outer wall (18) and a rear outer wall (19) in accordance with its angled shape, while a head portion (7) of the housing (4) extends transversely to a handle portion (6) of the housing (4), and depilation discs are provided at the tree end of the head portion (7). The cooling device (3) is provided for the major part in the region of the front outer wall (18) of the housing (4) of the depilation device (2).

4 Claims, 4 Drawing Sheets

DEPILATION SYSTEM WITH A DEPILATION DEVICE AND A COOLING DEVICE

FIELD OF THE INVENTION

The invention relates to a depilation system as defined in the preamble of claim 1.

BACKGROUND OF THE INVENTION

Such a depilation system as defined in the preamble of claim 1 is known, for example, from the patent document EP 0 348 862 A2. The cooling device in the known depilation system is connected to the depilation device in the region of a rear wall of the housing of the depilation device. The result of this is that the depilation means of the depilation device, which are formed by a drivable helical screw in the known depilation device, are practically not visible and can accordingly not be observed, which has the result that it is not possible to aim the depilation means accurately at hairs to be removed, which hampers a fast and effective depilation operation. Furthermore, this arrangement in the known depilation system has the result that the total longitudinal dimension of the depilation system is comparatively great, which has been found to be not very favorable for depilation operations in the regions of body cavities and inner curves of the body.

SUMMARY OF THE INVENTION

The invention has for its object to avoid the problems described above and to provide an improved depilation system.

To achieve the object formulated above, according to the invention, the characteristics as defined in the characterizing part of claim 1 are provided in a depilation system as defined in the preamble of claim 1. The provision of the characteristics according to the invention achieves in a simple manner that the depilation means of the depilation device are clearly visible, and can accordingly be well observed, during a depilation operation in spite of the cooling device connected to the depilation device, so that the depilation means can be accurately aimed at hairs to be removed, which is advantageous for a fast and effective depilation operation. Furthermore, the provision of the characteristics according to the invention achieves that the total longitudinal dimension of the depilation system can be made comparatively small, which has been found to be advantageous for a comfortable handling and for a satisfactory depilation operation in regions of body cavities and inner curves of the body.

Depilation means of various constructions may be provided in a depilation system according to the invention. It was found to be highly advantageous, however, when in addition the characteristics of claim 2 are present in a depilation system according to the invention. Such an arrangement was found to be particularly advantageous for achieving the best possible and painless removal of hairs to be removed in practical tests.

In a depilation system according to the invention with depilation discs as the depilation means, it was found to be particularly advantageous when in addition the characteristic of claim 3 is present. Pinching of skin portions between the depilation discs and the cooling device is very well prevented thereby.

In a depilation system according to the invention, furthermore, it was found to be very advantageous when in addition the characteristic of claim 4 is provided. Such an arrangement is remarkable for its particularly comfortable grip and a comfortable handling of a depilation system according to the invention.

The aspects described above and further aspects of the invention will become apparent from the following description of an embodiment and are explained in more detail with reference to this embodiment.

BRIEF DESCRIPTION OF THE DRAWINGS

The invention will now be explained in more detail below with reference to an embodiment shown in the drawings, to which, however, the invention is not limited.

DESCRIPTION OF THE PREFERRED EMBODIMENTS

Figure 1:
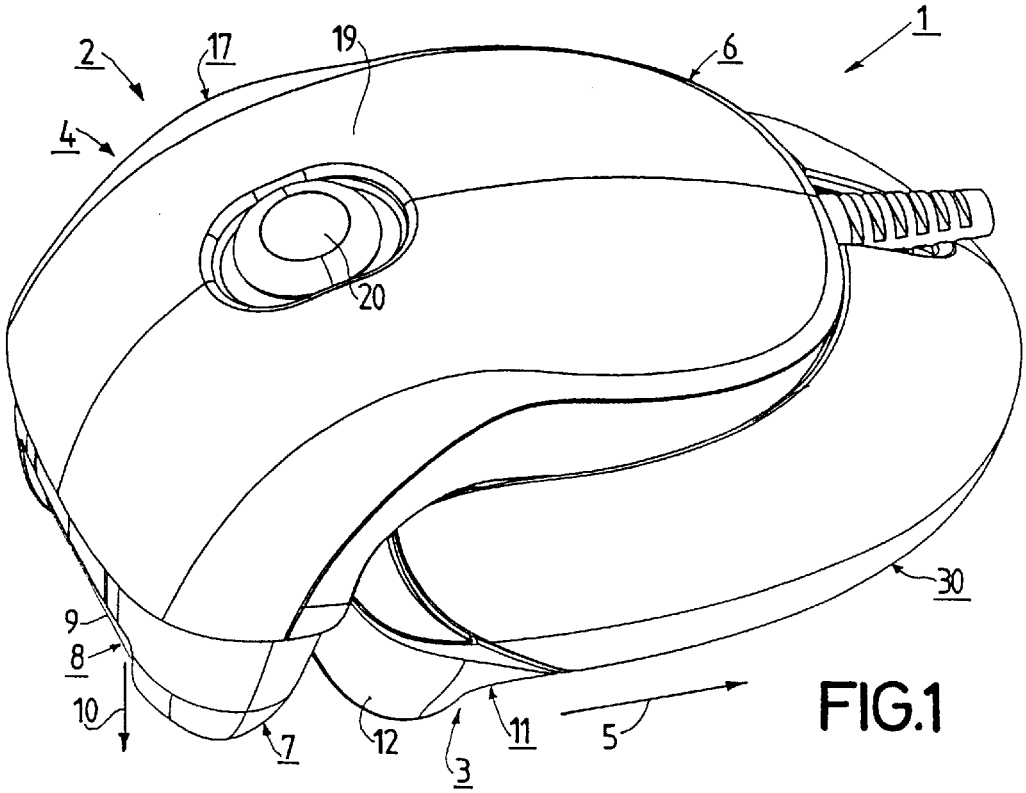
FIG. 1 is an elevation viewed obliquely from above of a depilation system according to the invention in an embodiment of the invention, consisting of a depilation device and a cooling device which are connected to one another by connection means.
Figure 2:
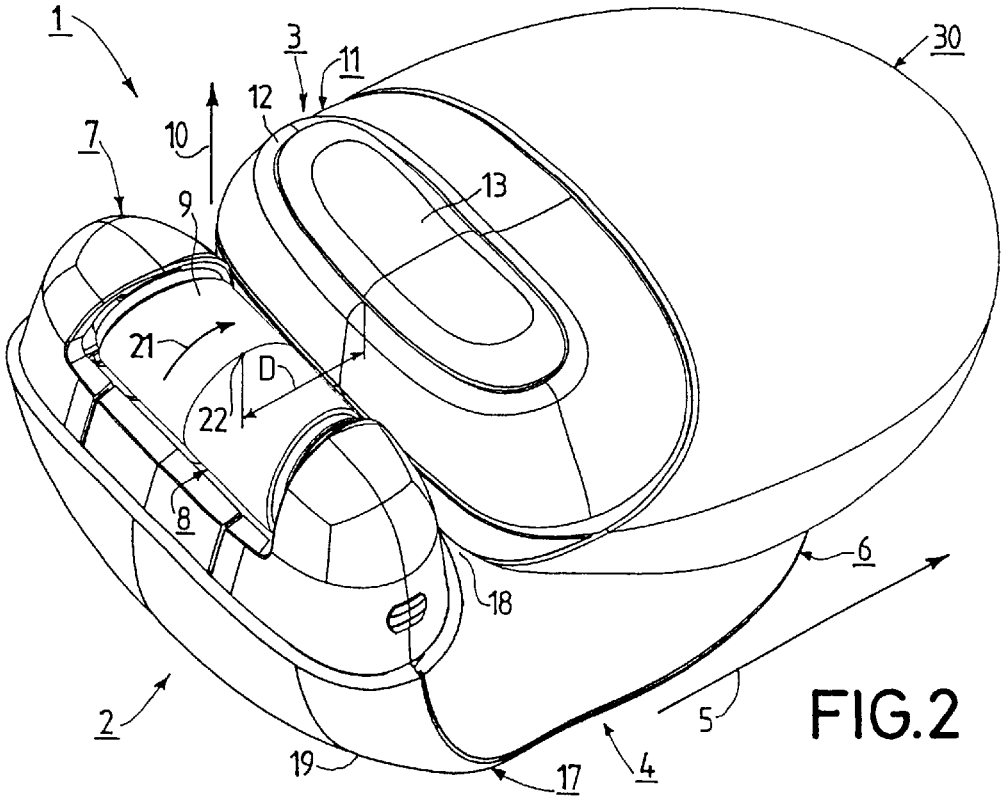
FIG. 2 is an elevation viewed obliquely from below of the depilation system of FIG. 1.
Figure 3:
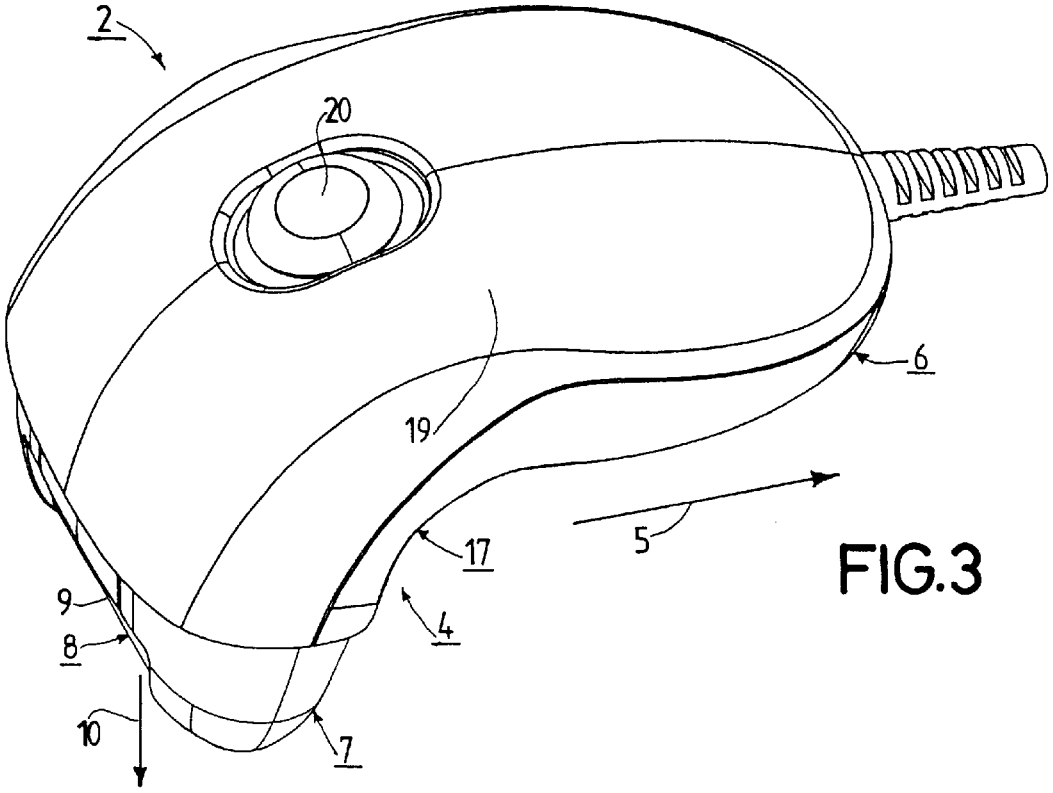
FIG. 3 is an elevation viewed obliquely from above of the depilation device of the depilation system of FIGS. 1 and 2.

FIGS. 1 and 2 show a depilation system 1 which consists of a depilation device 2 and a cooling device 3. The depilation device 2 and the cooling device 3 are detachably connected to one another by connection means which will be described in more detail further below. The depilation device 2 and also the cooling device 3 can be held in one hand during operation of the depilation system 1.

The depilation device 2, which is also often called epilation apparatus, comprises a housing 4 which is made of synthetic resin and for which a longitudinal housing direction can be defined as indicated with an arrow 5. The housing 4 comprises a handle portion 6 which extends substantially parallel to the longitudinal housing direction 5 and which is provided and constructed for holding the depilation device 2 in one hand during the operation of the depilation system 1. The housing 4 further comprises a head portion 7 connected to the handle portion 6. The depilation device 2 is provided with depilation means 8 in the region of the head portion 7, which means are constructed for removing hairs. The depilation means 8 are not shown in any detail in the depilation device 2. The depilation means are formed in a known manner by depilation discs which can be driven into rotation and which are arranged next to one another as seen along their axis of rotation, thus forming a so-called depilation cylinder 9 which is depicted in FIGS. 1, 2, 3, 4, and 8. Concerning such depilation means 8 formed by depilation discs, reference may be made to the two patent documents EP 0 532 106 B1 and EP 0 532 107 B11, whose disclosures are deemed to be included in the present application through reference to these patent documents.

The depilation means 8, i.e. the depilation discs, are arranged in the region of the head portion 7 of the housing 4 of the depilation device 2 in such a manner that they can be applied to a skin region to be depilated in an application direction which is transverse to the longitudinal housing direction 5. The application direction is indicated with an arrow 10 in FIGS. 1, 2, 3, 4, 5, 6, 8, and 9.

A depilation operation can be carried out with the depilation device 2 without the latter being combined with the cooling device 3. If such a depilation operation is carried out on skin regions or body regions which are comparatively sensitive to pain, however, it was found to be more pleasant and advantageous to use the depilation device 2 in combination with the cooling device 3, because the skin region to be depilated is cooled by the cooling device 3 before the removal of the hairs from the relevant skin region to be depilated, which leads to a clear reduction in pain.

The cooling device 3 comprises a housing 11 which is also made of synthetic resin and whose longitudinal housing direction corresponds substantially to the longitudinal housing direction 5 of the depilation device 2. The housing 11 of the cooling device 3 is constructed like a kind of bag and has in its region facing towards the head portion 7 of the depilation device 2 a projection 12 which extends over some distance, albeit only a small distance, in the application direction 10. The cooling device 3 is provided with a skin contact portion 13 in the region of the projection 12. The skin contact portion 13 can be applied to a skin region to be depilated in the application direction 10, in the same way as the depilation means 8. The skin contact portion 13 is designed for cooling down that skin region which is in contact therewith. The skin contact portion 13 has a certain skin contact surface area which will be discussed in more detail further below. The skin contact portion 13 here consists of a material with a certain thermal conductivity, which will also be discussed in more detail further below.

A certain quantity of a liquid cooling agent is present in the housing 11 of the cooling device 3, which is to be cooled in a separate freezing device, for example in a freezer compartment of a refrigerator or a home freezer. The cooling agent is not shown in the drawings. It is to be noted with reference to the cooling device 3 that the cooling device 3 has a certain cooling power for cooling skin regions by means of the skin contact portion 13.

The construction of the cooling device 3 in the depilation system 1 is such that the cooling power of the cooling device 3 has a value of approximately 10 W and the quantity of cooling agent is approximately 50 ml, while the contact surface area of the skin contact portion 13 has a value of approximately 5 $cm^2$, the thickness of the skin contact portion has a value of approximately 2.5 ml, and the thermal conductivity of the skin contact portion 13 has a value of approximately 120 W/mK. Such a thermal conductivity of the skin contact portion 13 is achieved when the material chosen for the skin contact portion 13 is aluminum.

The parameters indicated above were found to be particularly advantageous. It is expressly to be noted, however, that good compromises between the size and weight of the cooling device 3 on the one hand and a fast and adequate operation of the cooling device 3 on the other hand can be achieved also with parameters differing from the above preferred parameters. Tests carried out at the applicant's have proven, however, that certain minimum values are to be observed. It was found that the power of the cooling device 3 must have a value of at least 3 W, the quantity of cooling agent a value of at least 20 ml, and the contact surface area of the skin contact portion 13 a value of at least 3 $cm^2$ if satisfactory results are to be achieved. It was also found in these tests, however, that upper limits are useful for the parameters given above. It was found that the power of the cooling device 3 should have a value lying in a range from 3 W to 15 W, the quantity of cooling agent should have a value lying in a range from 20 ml to 80 ml, and the contact surface area of the skin contact portion 13 should have a value lying in a range between 3 $cm^2$ and 11 $cm^2$.

Figure 8:
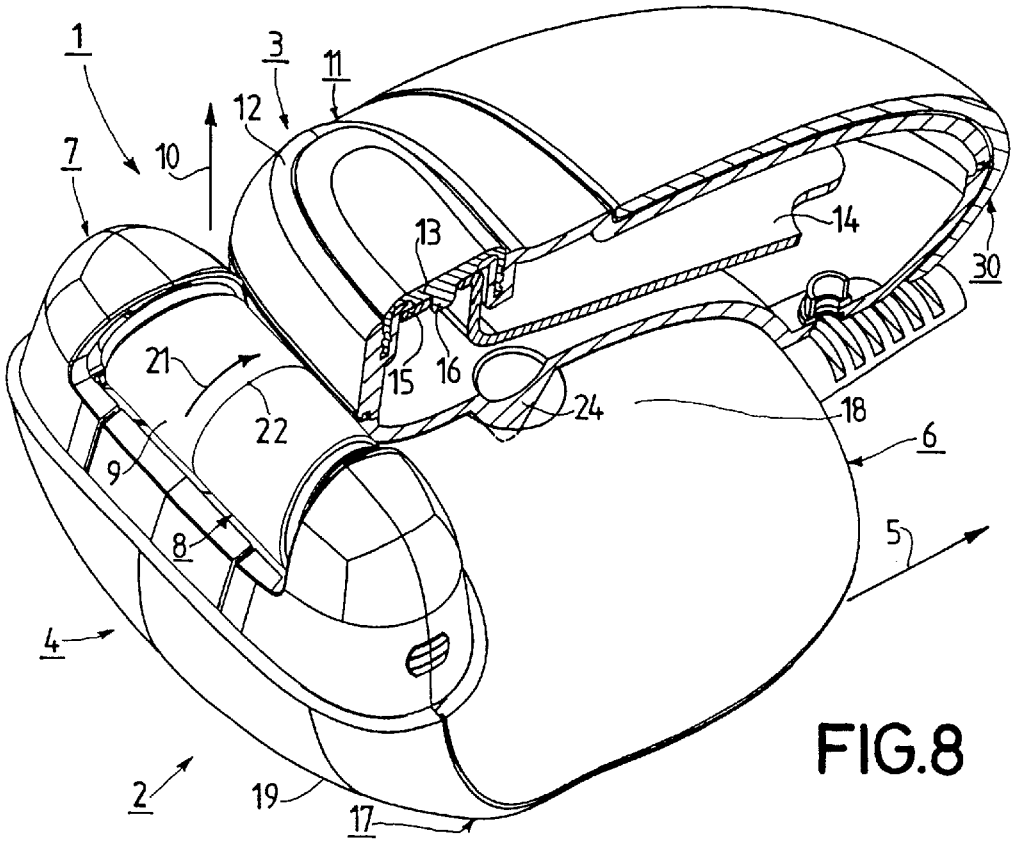
FIG. 8 shows in the same manner as FIG. 2 the depilation system of FIGS. 1 and 2, however, only one half of the cooling device is shown here.
Figure 9:
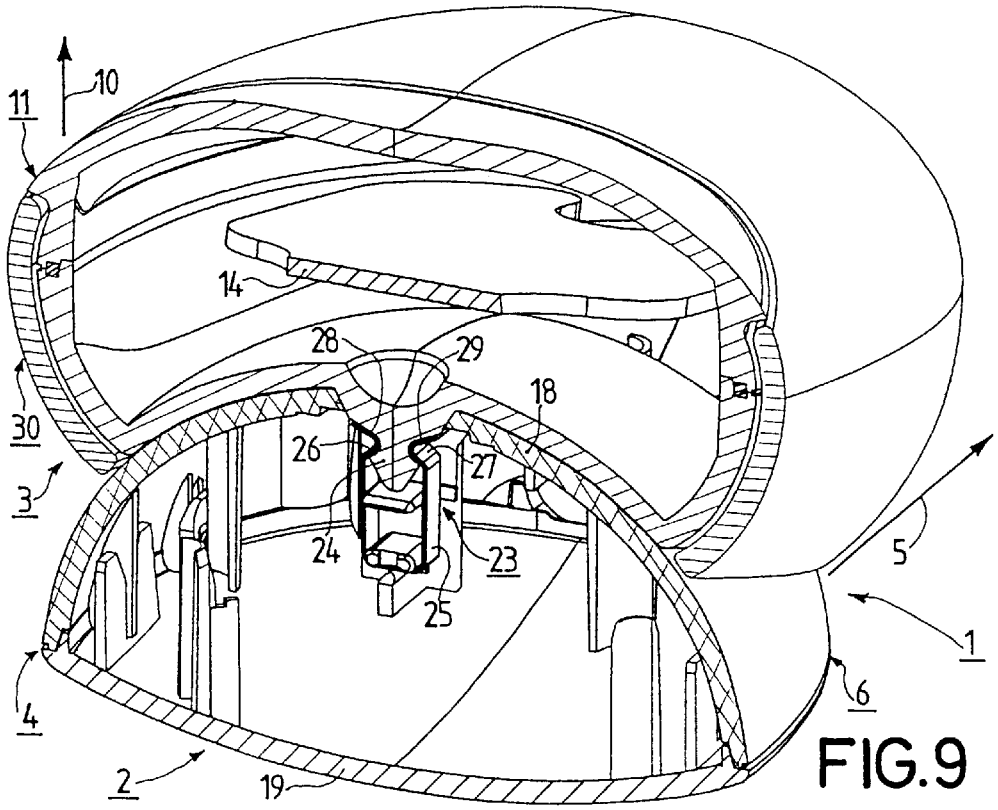
FIG. 9 is an elevation viewed obliquely from above of a cut-off portion of the depilation device and the cooling device, the cut being made through the connection means between the depilation device and the cooling device.

It should be noted on the construction of the cooling device 3 that the skin contact portion 13, as is evident from FIGS. 8 and 9, is connected to a substantially plate-shaped heat transport part 14 in the interior of its housing 11, which heat transport part is surrounded by the cooling agent which is not shown in FIGS. 8 and 9. The heat transport part 14 has two bends at its end facing towards the skin contact portion 13 and is provided with a slot in the region of the bent end 15 through which a ridge 16 projecting from the skin contact portion 13 is passed, such that a good mechanical and good thermally conducting connection between the heat transport part 14 and the skin contact portion 13 is realized by means of this ridge 16. The heat transport part is also made from a material with good thermal conduction, with a thermal conductivity of approximately 120 W/mK, for example aluminum, so that a good heat exchange between the cooling agent and the skin contact portion 13 is achieved by means of the heat transport part 14. The surfaces of the skin contact portion 13 and of the heat transport part 14 wetted by the cooling agent together form a wetting surface area of approximately 40 $cm^2$. The wetting surface is accordingly comparatively large, because both main surfaces of the heat transport part contribute to forming the wetting surface. It should be noted on the cooling agent, which is not shown, that the cooling agent consists of a mixture of water, a coloring agent, and a preserving agent.

The constructional arrangement of the depilation device 2 of the depilation system 1 is advantageously chosen such that the housing 4 of the depilation device 2 is of angled design, and that the head portion 7 here extends substantially transversely to the handle portion 6, and accordingly to the longitudinal housing direction 5. In the present case, the handle portion 6 and the head portion 7 are practically perpendicular to one another; however, this need not necessarily be the case. Advantageously, furthermore, the depilation means 8 are provided at the free end of the head portion 7 facing away from the handle portion 6 in this case. It should further be noted that the handle portion 6 and the head portion 7 of the depilation device 2 are interconnected by means of a curved transitional portion 17.

In accordance with its angled shape, the housing 4 of angled design of the depilation device 2 has a front outer wall 18 and a rear outer wall 19. A switching means 20 for switching the depilation device 2 on and off is provided in the region of the rear outer wall 19.

As is apparent from FIGS. 1, 2, 8, and 9, the constructional arrangements of the depilation device 2 and the cooling device 3 in the depilation system 1 are chosen and mutually attuned such that the cooling device 3 is detachably connected to the depilation device 2 mainly in the region of the front outer wall 18 of the housing 4 of the depilation device 2. It is achieved in a simple manner by this arrangement that the depilation means, i.e. the depilation discs, are well visible during a depilation operation in spite of the cooling device 3 being connected to the depilation device 2, so that the depilation discs can be accurately aimed at hairs which are to be removed. This advantageous constructional arrangement furthermore achieves a comparatively short total longitudinal dimension of the depilation system 1, which is advantageous for a comfortable handling and a good accessibility of hairs to be removed in the regions of body cavities and inner curves of the body.

Figure 4:
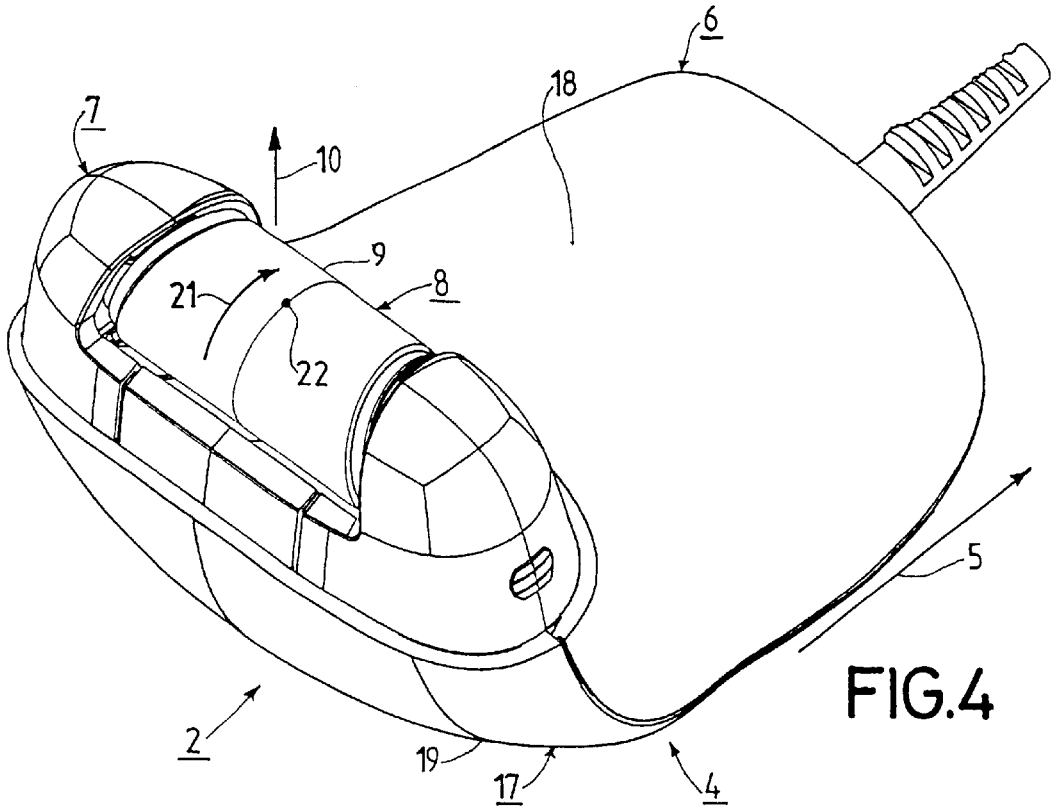
FIG. 4 is an elevation viewed obliquely from below of the depilation device of FIG. 3.
Figure 5:
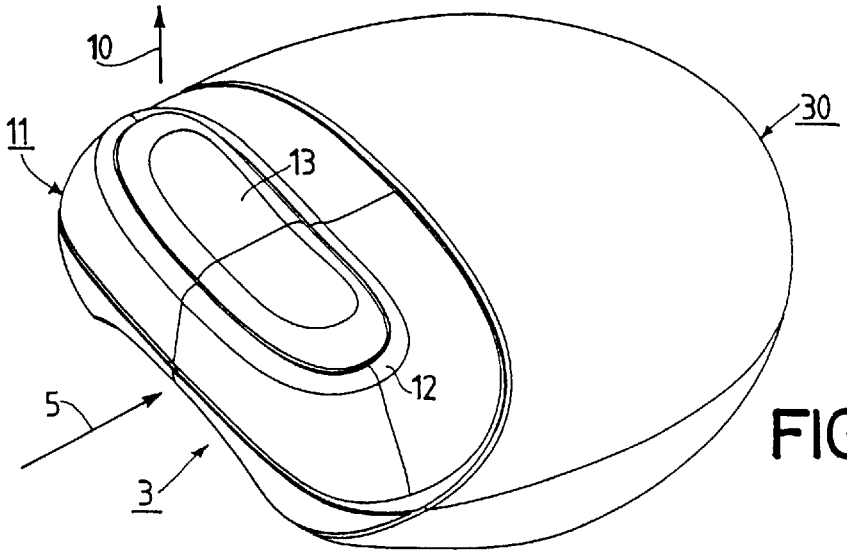
FIG. 5 is an elevation viewed obliquely from below of the cooling device of the depilation system of FIGS. 1 and 2, which cooling device is provided with an envelope made of a thermally insulating material.
Figure 6:
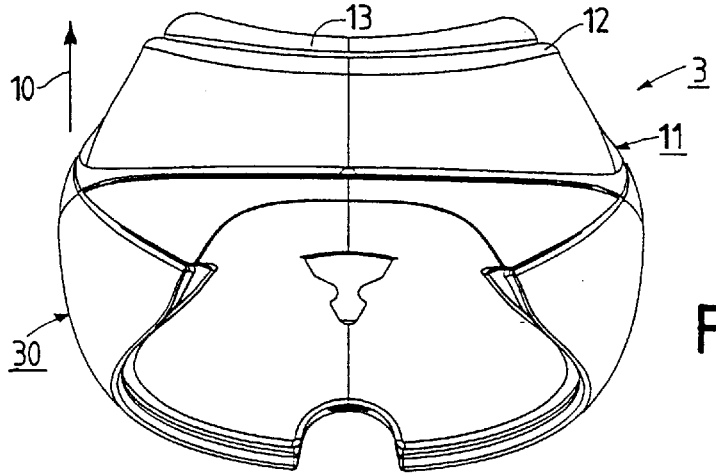
FIG. 6 is a front elevation of the cooling device of FIG. 5 with its envelope.

It should be noted on the depilation discs that the drive of the depilation discs, which can be driven into rotation, is chosen and constructed in the depilation system 1 such that the depilation discs rotate in a direction of rotation as indicated with an arrow 21 in FIGS. 2, 4, and 8 during operation. In other words, the depilation discs rotate in a rotation direction 21 such that the summit 22 of each depilation disc facing away from the handle portion 6 moves in the direction of the front outer wall 18 of the housing 4 of the depilation device 2, i.e. towards the cooling device 3 and the skin contact portion 13. This direction of rotation of the depilation discs was found to be particularly advantageous for a good depilation operation. The distance D (see FIG. 2) between the relevant summit 22 of each depilation disc and the end region of the skin contact portion 13 lying closest to the depilation discs has a value of approximately 16 mm. A painful pinching of skin portions is very effectively prevented in this manner.

It should be noted on the implementation of a depilation operation with the depilation system 1 that the depilation system 1 is conducted by hand over the skin regions to be depilated parallel to the longitudinal housing direction 5 during such a depilation operation, so that first the skin contact portion 13 comes into contact with a skin portion to be depilated and thus provides a cooling-down of this skin portion, and that subsequently the depilation means 8, i.e. the depilation discs, come into operational contact with the skin region which was cooled down immediately before, thus ensuring a comparatively painless extraction of the hairs to be removed.

As was noted above, the cooling device 3 is detachably connected to the depilation device 2. Connection means consisting of mutually separable connection parts are provided for the detachable connection of the depilation device 2 and the cooling device 3 in the depilation system 1. The construction of these connection means will be described in detail below with reference to FIG. 9.

The connection means are advantageously formed by snap connection means 23 which consist of a snap projection 24 projecting from one of the two devices 2 and 3 and a snap catch 25 provided in the other one of the two devices 2 and 3 and designed for accommodating the snap projection 24. In the present case, the snap projection 24 extends from the cooling device 3, i.e. from the housing 11 of the cooling device 3. The snap catch 25 is provided in the depilation device 2 here.

As is visible in FIG. 9, the snap catch 25 is formed by a substantially U-shaped retaining spring. The retaining spring acting as the snap catch 25 has two free ends 26 and 27 which show a substantially V-shaped gradient and which face one another with their crest portions. The snap projection 24 has two depressions 28 and 29 which are also V-shaped and which face one another with their deepest points, and which are designed for abutting and being locked against the free ends 26 and 27 of the retaining spring provided as the snap catch 25. The snap projection 24 has an overall tapering shape towards its free end, in particular between its two snap depressions 28 and 29 and its free end, whereby advantageously the separation of the snap connection means 23 is supported.

Connection forces acting between the depilation device 2 and the cooling device 3 can be realized by means of the snap connection means 23 provided in the depilation system 1, which forces lie within a narrow range of forces defined by the construction of the snap connection means 23, which brings with it the advantage that, should the depilation system 1 drop to the ground, the snap connection means 23 will automatically and with certainty become disconnected as a result of the forces occurring during such a drop, so that the depilation device 2 and the cooling device 3 are automatically separated from one another. It is achieved thereby that the comparatively heavy cooling device 3 cannot cause any damage or even destruction of the depilation device 2 if the depilation system 1 should be dropped.

Figure 7:
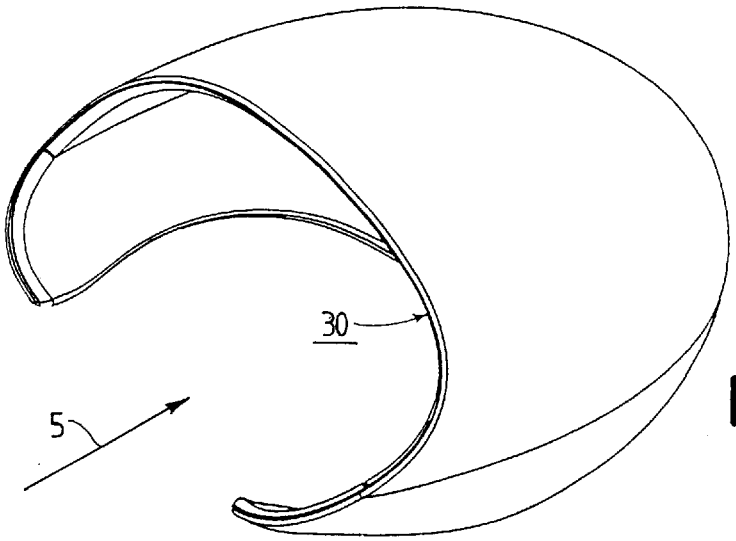
FIG. 7 is an elevation viewed obliquely from below of the envelope of the cooling device shown in FIGS. 5 and 6.

A further advantageous measure should be discussed with reference to the cooling device 3. The cooling device 3 is provided with an envelope 30 which is separately depicted in FIG. 7 and which is made from a material with a good heat insulation, i.e. of synthetic resin. The envelope 30 has a shape adapted to the outer shape of the housing 11 of the cooling device 3. The envelope 30 covers the housing 11 of the cooling device 3 with heat insulation at least in the region which is in contact with a hand during the operation of the depilation system 1. It is achieved thereby that the hand holding the depilation system 1 during operation cannot come into contact at all with the very cold housing 11 of the cooling device 3, so that no unpleasant or painful cold influence is exerted on the hand, so that also in this respect a pleasant handling of the depilation system 1 is safeguarded.

The envelope 30 is detachably connected to the housing 11 of the cooling device 3 and is constructed such that it can be taken by hand from the housing 11 of the cooling device 3 in a simple manner without any auxiliary tools. The envelope 30 is in fact resilient and is retained to the housing 11 of the cooling device 3 by its own resilient force.

The fact that the cooling device 3 is provided with the thermally insulating envelope 30 achieves not only that a user's hand holding the depilation system 1 during operation is protected from cold, but also that a condensation of water at the outside of the housing 11 of the cooling device 3 is prevented or reduced to a minimum at least in the region covered by the envelope 30.

What is claimed is:

1. A depilation system (1) comprising a depilation device (2), which can be held in one hand during operation and which comprises a housing (4) having a handle portion (6) to be held in one hand and extending substantially parallel to a longitudinal housing direction (5) a head portion (7) connected to said handle portion (6), and depilation means (8) constructed for the removal of hairs;

which means are provided in a region of the head portion (7) and are arranged such that they can be applied to a skin region to be depilated in an application direction (10) which is transverse to the longitudinal housing direction (5); and a cooling device (3) which is detachably connected to the depilation device (2), said cooling device provided with a skin contact portion (13) which can be applied to a skin region to be depilated in the application direction (10) in the same way as the depilation means (8), and which is designed for cooling down the skin region;

wherein the housing (4) of the depilation device (2) is of an angled design and has in accordance with its angled shape a front outer wall (18) and a rear outer wall (19);

the head portion (7) is constructed so as to be substantially perpendicular to the handle portion (6) and thus to the longitudinal housing direction (5);

the depilation means (8) are provided at a free end of the head portion (2) facing away from the handle portion (6); and at least a major portion of the cooling device (3) lies in a region of the front outer wall (18) of the housing of said depilation device (2).

2. A depilation system (1) as claimed in claim 1, wherein the depilation means (8) of the depilation device (2) are formed by depilation discs which can be driven into rotation and which rotate during operation in a direction of rotation (21) such that summit (22) of each depilation disc facing away from the handle portion (6) moves in the direction of the front outer wall (18), and thus in a direction of the cooling device (3).

3. A depilation system (1) as claimed in claim 2, wherein the distance (D) between the summit (22) of each depilation disc and the end region of the skin contact portion (13) lying closest to the depilation discs has a value of at least 10 mm.

4. A depilation system (3) as claimed in claim 1, wherein the handle portion (6) and the head portion (7) are connected to one another by means of a transitional portion (17) of curved shape.

* * * * *